US012595598B2

(12) United States Patent
Vainer et al.

(10) Patent No.: US 12,595,598 B2
(45) Date of Patent: Apr. 7, 2026

(54) KNIT SPACER FABRIC

(71) Applicant: MMI-IPCO, LLC, Spartanburg, SC (US)

(72) Inventors: Gadalia Vainer, Melrose, MA (US); William Michael Rose, East Hampstead, NH (US)

(73) Assignee: Milliken & Company, Spartanburg, SC (US)

( * ) Notice: Subject to any disclaimer, the term of this patent is extended or adjusted under 35 U.S.C. 154(b) by 336 days.

(21) Appl. No.: 18/344,423

(22) Filed: Jun. 29, 2023

(65) Prior Publication Data

US 2024/0026580 A1 Jan. 25, 2024

Related U.S. Application Data

(60) Provisional application No. 63/390,409, filed on Jul. 19, 2022.

(51) Int. Cl.
*D04B 1/10* (2006.01)
*D04B 1/24* (2006.01)

(52) U.S. Cl.
CPC ..... *D04B 1/102* (2013.01); *D04B 1/24* (2013.01)

(58) Field of Classification Search
CPC ..... D04B 1/102; D04B 1/104; D04B 1/24; D04B 21/06; D04B 21/10; D04B 21/207
See application file for complete search history.

(56) References Cited

U.S. PATENT DOCUMENTS

| | | | | |
|---|---|---|---|---|
| 5,651,847 | A | 7/1997 | Loeffler | |
| 5,908,673 | A * | 6/1999 | Muhlberger | D04B 21/16 428/116 |
| 7,465,683 | B2 | 12/2008 | McMurray | |
| 10,233,574 | B2 | 3/2019 | Wan | |
| 11,560,654 | B2 | 1/2023 | Diaz | |

(Continued)

FOREIGN PATENT DOCUMENTS

| | | |
|---|---|---|
| DE | 19910785 | 9/2000 |
| EP | 2964044 B1 | 12/2019 |

(Continued)

OTHER PUBLICATIONS

English translation of DE 19910785 A1 to Heide et al. obtained from PE2E database (Year: 2000).*
PCT/US2023/026920 Search Report WIPO—Oct. 23, 2023, 6 pages.

*Primary Examiner* — Jeremy R Pierce
(74) *Attorney, Agent, or Firm* — Cheryl J. Brickey

(57) ABSTRACT

A knit spacer fabric contains an upper fabric layer with a plurality of upper yarns and forming the upper surface of the knit spacer fabric and a lower fabric layer with a plurality of lower yarns and forming the lower surface of the knit spacer fabric. The knit spacer fabric further contains a plurality of zipper connecting yarns and a plurality of linking connecting yarns. The upper fabric layer contains a plurality of spaced apart parallel knitted upper columns, each formed from at least two upper yarns knitted together and the upper yarns from one column are not knitted with the upper yarns of adjacent columns. At least a portion of the zipper connecting yarns stitch together two adjacent upper columns and at least a portion of the linking connecting yarns stitch together in one lower and one upper column.

19 Claims, 3 Drawing Sheets

(56) References Cited

U.S. PATENT DOCUMENTS

| | | | | |
|---|---|---|---|---|
| 11,655,568 | B2 | 5/2023 | Rose | |
| 11,712,077 | B2 | 8/2023 | Moretti Polegato | |
| 11,725,310 | B2 | 8/2023 | Rose | |
| 11,812,831 | B1 | 11/2023 | Leith | |
| 11,821,117 | B2 | 11/2023 | Poegl | |
| 2002/0152776 | A1* | 10/2002 | Didier Laurent | D04B 1/16 66/196 |
| 2008/0179030 | A1* | 7/2008 | O'Connor | D04B 1/22 162/201 |
| 2019/0062963 | A1* | 2/2019 | Heiner | D04B 21/10 |
| 2019/0208862 | A1 | 7/2019 | Poegl | |
| 2020/0338853 | A1* | 10/2020 | Mueller | D04B 21/16 |
| 2021/0285132 | A1 | 9/2021 | Wu | |
| 2025/0092586 | A1* | 3/2025 | Dandapure | D04B 1/24 |

FOREIGN PATENT DOCUMENTS

| | | | |
|---|---|---|---|
| EP | 3904577 | B1 | 5/2023 |
| EP | 3861158 | B1 | 7/2023 |
| EP | 4232624 | A1 | 8/2023 |
| EP | 4234787 | A2 | 8/2023 |
| JP | 2014185419 | | 10/2014 |

* cited by examiner

KNIT SPACER FABRIC

RELATED APPLICATIONS

This application claims priority to co-pending U.S. Provisional Patent Application 63/390,409 filed on Jul. 19, 2022, which is herein incorporated by reference in its entirety.

TECHNICAL FIELD OF THE INVENTION

The present invention is directed towards knit spacer fabrics, more particularly to knit spacer fabrics for use as insulation for garments.

BACKGROUND

Performance fabrics manufactured for use in insulating garments often include fleece fabric, i.e. fabric having a raised or brushed fiber surface for improved insulation performance. The surface of such fabrics is often formed of fleece, which is raised, i.e., given relatively higher loft, by mechanical brushing. It has, however, been recognized that the brushing process can often result in broken fibers, which, over time, can work loose, potentially resulting in microfiber pollution. Loss of fibers, e.g., during washing, can also result in deterioration of insulation performance. Further, it is recognized that broken fibers released during washing can get into wastewater, causing pollution. It is desirable to have a low fiber loss, low weight, and high insulative fabric for use in outerwear and other garment uses.

BRIEF SUMMARY OF THE INVENTION

The invention relates to A knit spacer fabric contains an upper fabric layer containing a plurality of upper yarns, where the upper fabric layer forms the upper surface of the knit spacer fabric. The knit spacer fabric also contains a lower fabric layer containing a plurality of lower yarns, where the lower fabric layer forms the lower surface of the knit spacer fabric. The knit spacer fabric further contains a plurality of zipper connecting yarns and a plurality of linking connecting yarns.

The upper fabric layer contains a plurality of spaced apart parallel knitted upper columns, where each upper column is formed from at least two upper yarns knitted together and the upper yarns from one column are not knitted with the upper yarns of adjacent columns. The lower fabric layer contains a plurality of spaced apart parallel knitted lower columns, where each lower column is formed from at least two lower yarns knitted together and the lower yarns from one column are not knitted with the lower yarns of adjacent columns. At least a portion of the zipper connecting yarns contain a repeating pattern of at least one stitch in one upper column and at least one stitch in an adjacent upper column and at least a portion of the linking connecting yarns contain a repeating pattern of a plurality of stitches in a single lower column and at least one stitch in one upper column.

DETAILED DESCRIPTION

Figure 1:
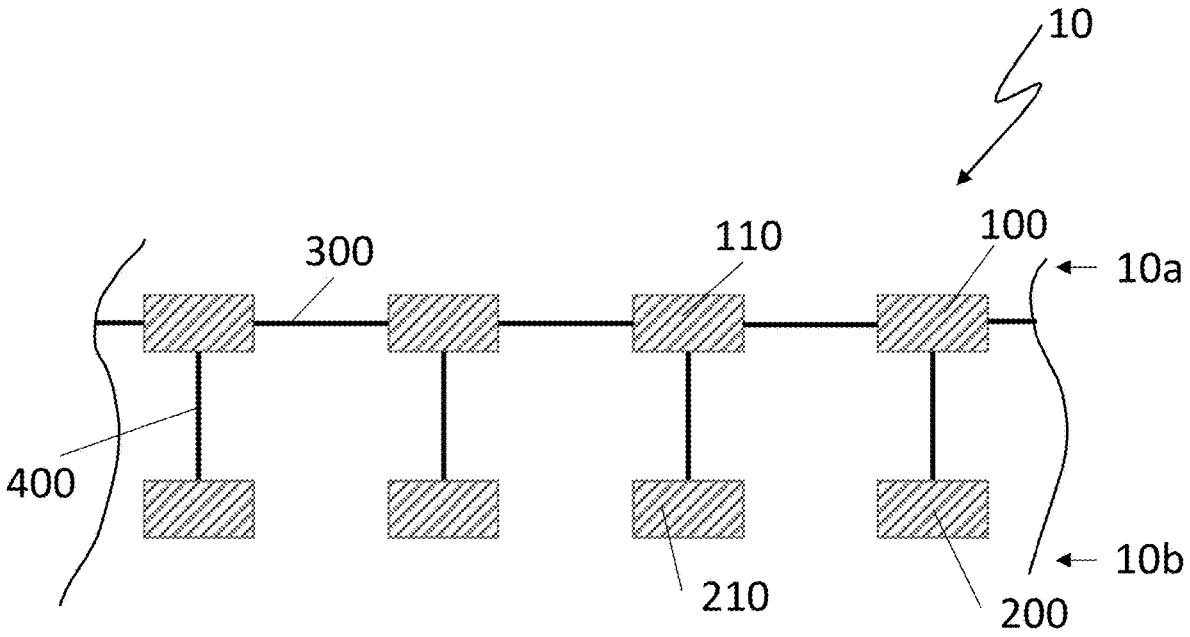
FIG. 1 is an illustration of a simplistic illustration of cross-section of the knit spacer fabric according to one embodiment of the invention.

Referring now to FIG. 1, the knit spacer fabric 10 of the invention has an upper surface 10*a* and a lower surface 10*b*, and contains an upper fabric layer 100, a lower fabric layer 200, a plurality of zipper connecting yarns 300, and a plurality of linking connecting yarns 400. The upper fabric layer 100 forms the upper surface 10*a* of the knit spacer fabric 10 and the lower fabric layer 200 forms the lower surface 10*b* of the knit spacer fabric 10.

Figure 2:
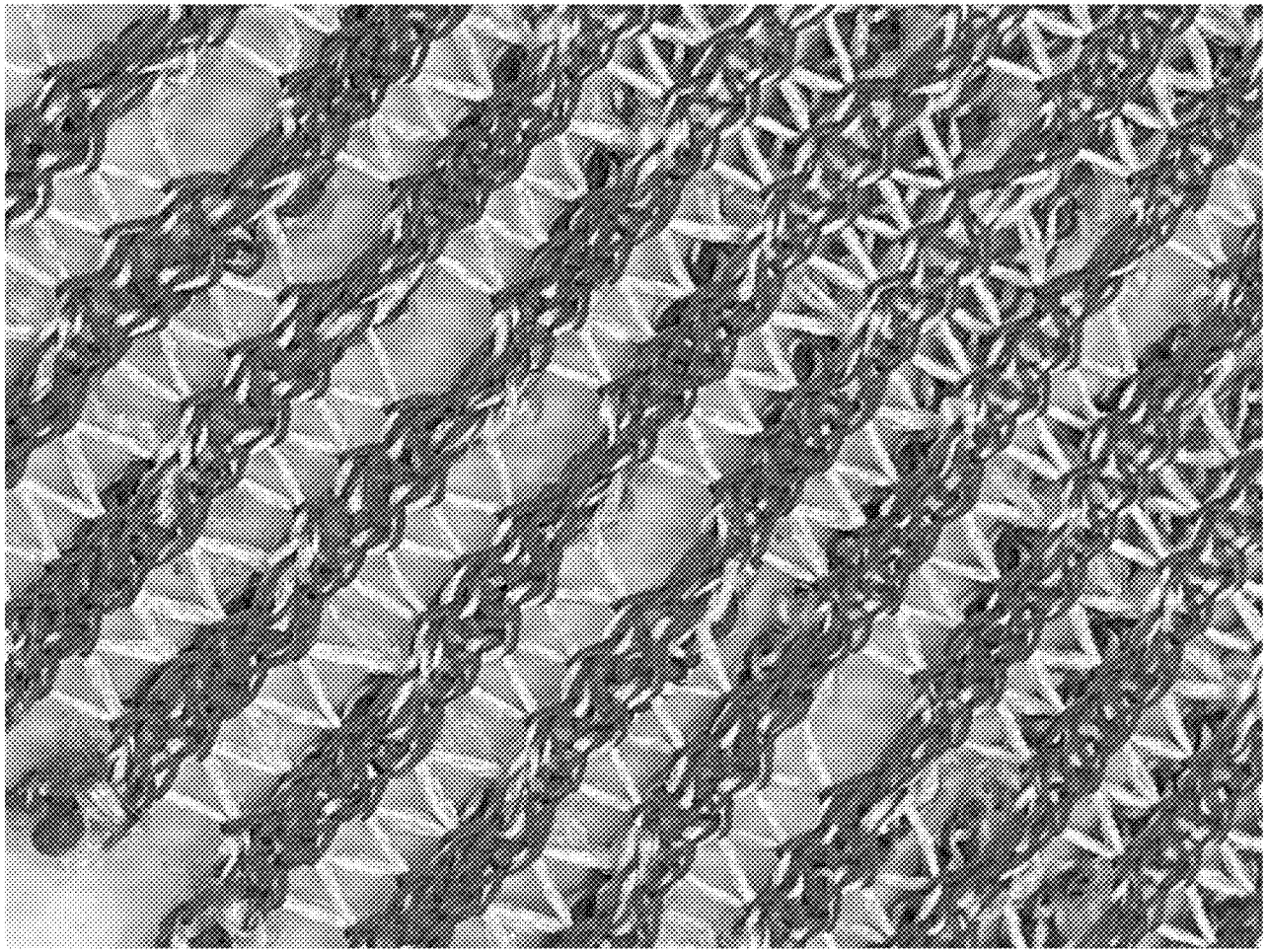
FIG. 2 is photograph of the upper surface of the knit spacer fabric according to one embodiment of the invention.

The upper fabric layer 100 contains a plurality of spaced apart parallel knitted upper columns 110, which is shown as a small rectangle in FIG. 1 for simplicity and ease of understanding the knit structure. Each upper column 110 of the upper fabric layer 100 is formed from at least two upper yarns knitted together and the upper yarns from one column are not knitted with the upper yarns of adjacent columns. In one embodiment, each upper column is formed from at least two upper yarns and at least one zipper connecting yarn knitted together. This means that if the zipper connecting yarns 300 were missing or cut, the upper columns 110 would be completely separate, stand-alone knitted columns. At least a portion of the zipper connecting yarns comprise a repeating pattern of at least one stitch in one upper column and at least one stitch in an adjacent upper column. Preferably, the repeating pattern of each zipper connecting yarns is to stitch only on two adjacent upper columns 110. For example, a zipper connecting yarn starts with making a stitch on a first upper column, then makes a stitch on an adjacent upper column, then returns to stitch again on the first upper column. A single zipper connecting yarn only travels between two adjacent upper columns and never travels to an additional third column. This stitching forms a zipper-like stitch appearance which can be seen in FIG. 2. FIG. 2 is a photograph of one embodiment of the knit spacer fabric as viewed from the upper surface of the knit spacer fabric. The lower fabric layer is not easily seen in this photograph as the lower columns 210 are blocked from view by the upper columns 110. In this example photograph, the zipper connecting yarns are white and one can see the upper appearance of the stitching between two adjacent upper columns 110. In one embodiment, each upper column is formed from at least two upper yarns knitted together in a pillar stitch. In an alternative embodiment, the zipper yarn stitches on three or more columns. For example, the zipper connecting yarn starts with making a stitch on a first upper column, then makes a stitch on an adjacent upper column, then continues to make a stitch on a third column, then returns to stitch again on the adjacent upper column, and then on the first upper column.

The stitch pattern of the zipper connecting yarns 300 helps control the spacing (and density per inch) of the upper columns. One can imagine that a tighter stitch of the zipper connecting yarns would create smaller "zipper" like structures and upper columns that are closer together. A looser stitch of the zipper connecting yarns would create larger "zipper" like structures and upper columns that are further apart. The distance between the upper columns can affect the fabric stability, insulation value, and manufacturing cost. In a preferred embodiment, the average distance between the upper columns (measured from the center line of one upper column to the center line of an adjacent upper column) is between about 0.25 mm and 30 mm, more preferably between about 1 mm and 10 mm, more preferably between about 1 mm and 4 mm.

Figure 3:
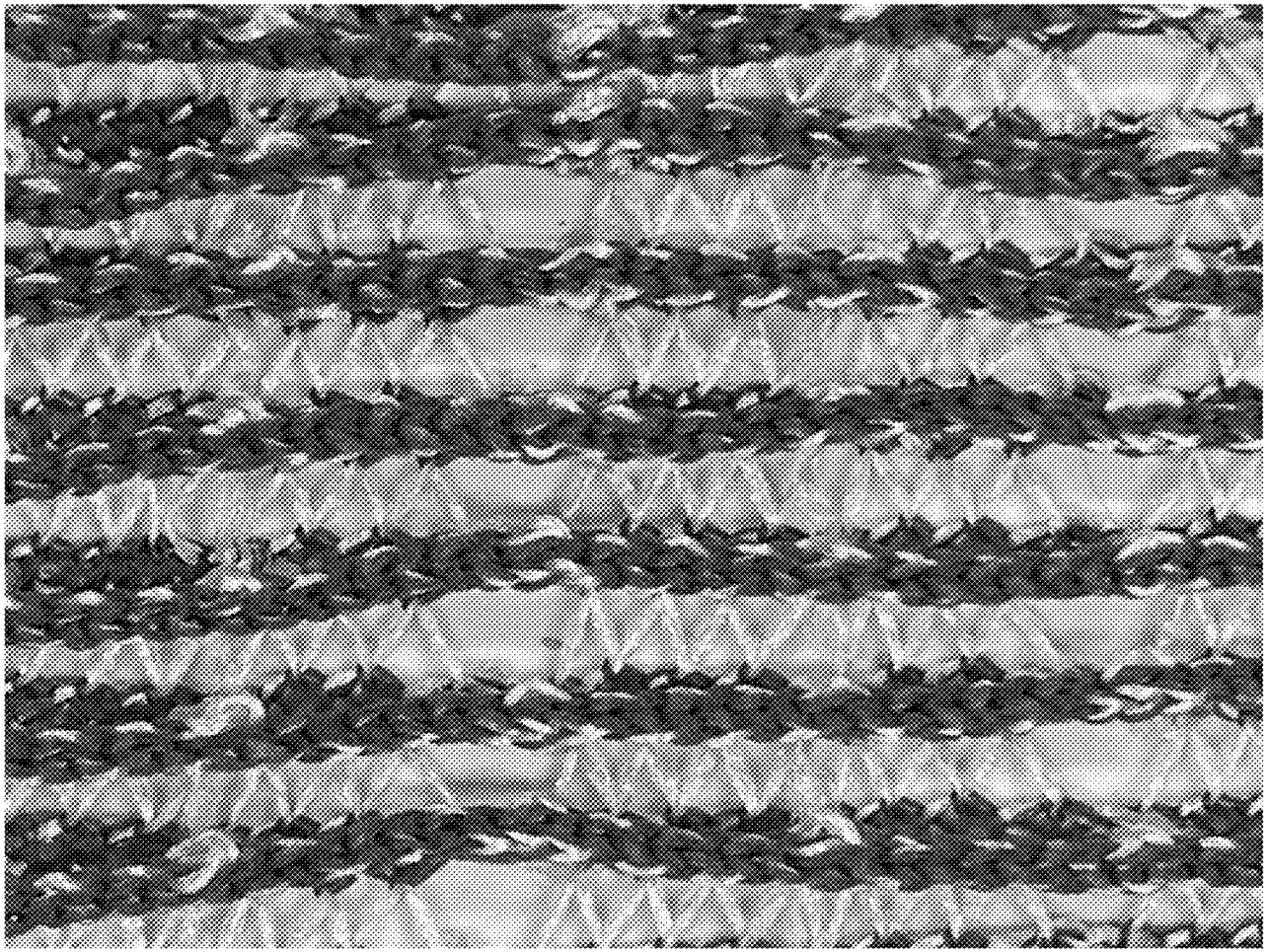
FIG. 3 is angled photograph of the knit spacer fabric according to one embodiment of the invention.

Referring back to FIG. 1, the knit spacer fabric 10 also contains a lower fabric layer 200 which forms the lower surface 10*b* of the knit spacer layer 10. The lower fabric layer contains a plurality of spaced apart parallel knitted lower columns 210 which are shown in the simplistic illustration of FIG. 1 as rectangles. Each lower column 210 is formed from at least two lower yarns knitted together and the lower yarns from one lower column are not knitted with the lower yarns of adjacent lower columns. Preferably, the lower columns are not directly attached to each other in any way and if they were not attached to the upper columns, then the lower columns would be completely separate and not attached within the knit spacer fabric 10 at all. The zipper connecting yarns 300 are not stitched or knitted in the lower fabric layer 200. The upper columns and the lower columns are parallel to each other (in this application parallel is defined to be substantially as these are knits and the columns, yarns, and stitches may shift and move during knitting, sewing into a garment, wearing the garment, and/or laundering). The upper and lower columns are preferably parallel and are also in registration meaning that there is an upper column above each lower column. This can be seen, for example, in FIG. 2 where essentially none of the lower fabric layer can be seen and in FIG. 3 (which is an image of the lower surface of the knit spacer fabric) where essentially none of the upper fabric layer can be seen. For every lower column, there is a corresponding upper column over and in registration with the lower column.

The knit spacer fabric 10 also contains linking connecting yarns 400 (shown in FIG. 1). These linking connecting yarns 400 connect the lower fabric layer to the upper fabric layer and the lower columns to the upper columns. Each linking connecting yarn only travels between one lower column and one upper column (the upper column directly above and in registration with the lower column). The linking connecting yarns do not connect lower columns together with each other or upper columns together with each other. Because each lower column is only attached to an upper column, the lower surface of the knit spacer fabric has almost a fin-like appearance (with the lower columns forming the "fins") and the lower columns also have some amount of movement because of the minimal attachments. At least a portion of the linking connecting yarns 400 comprise a repeating pattern of a plurality of stitches in a single lower column and at least one stitch in one upper column. For example, a linking connecting yarn starts with making a number of stitches on a first lower column, then makes a stitch on the corresponding and in registration upper column, then returns to stitch again on the first lower column. In one embodiment, each lower column is formed from at least two lower yarns knitted together in a pillar stitch.

The stitch pattern of the linking connecting yarns 400 helps control the spacing between the upper and lower fabric layers 100, 200 and the overall thickness of the knit spacer fabric 10. One can imagine that a tighter stitch of the linking connecting yarns would create smaller pieces of yarn to connect the upper and lower columns and a thinner fabric 10. A looser stitch of the linking connecting yarns would create larger pieces of yarns connecting the lower and upper columns and a thicker fabric 10. The distance between the two fabric layers 100, 200 can affect the fabric stability, insulation value, and manufacturing cost. In a preferred embodiment, the average distance between the upper fabric layer to the lower fabric layer is between about 1 and 75 mm, more preferably between about 2 and 20 mm, more preferably between about 2 and 10 mm. Overall, the fabric preferably has a thickness of between about 4 and 12 mm.

The knit spacer fabric contains at least first yarns that help form the first fabric layer, second yarns that help form the second layer, the zipper connecting yarns, and the linking connecting yarns. Each of these yarns may be any suitable yarn. "Yarn", in this application, as used herein includes a monofilament elongated body, a multifilament elongated body, ribbon, strip, yarn, tape, fiber and the like. The yarns described above may contain one type of yarn or a plurality of any one or combination of the above. The yarns may be of any suitable form such as spun staple yarn, monofilament, or multifilament, single component, bi-component, or multi-component, and have any suitable cross-section shape such as circular, multi-lobal, square or rectangular (tape), and oval.

The yarns of the knit spacer layer may be formed of (but are not limited to) cellulosic yarns (such as cotton, rayon, linen, jute, hemp, cellulose acetate, and combinations, mixtures, or blends thereof), polyester yarns (e.g., poly(ethylene terephthalate) yarns, poly(propylene terephthalate) (PET) yarns, poly (trimethylene terephthalate) yarns), poly(butylene terephthalate) yarns, and blends thereof), polyamide yarns (e.g., nylon 6 yarns, nylon 6.6 yarns, nylon 4.6 yarns, and nylon 12 yarns), polyvinyl alcohol yarns, an elastic polyester-polyurethane copolymer (SPANDEX®), polypropylene yarns, polyethylene yards, polyvinyl acetate yarns, polylactic acid yarns, flame-resistant meta-aramid (NOMEX®) or para-aramid, and combinations, mixtures, or blends thereof.

In one preferred embodiment, the yarns of the fabric 10 contain multifilament polyester yarns as these have been shown to have good performance at low cost. In one embodiment, all yarns within the fabric 10 contain essentially all (defined as being at least about 98% by weight) multifilament polyester yarns. In one embodiment, the yarns that make up the different parts of the fabric 10 all have approximately the same thickness or denier. In other embodiments, there is a difference in denier. In another embodiment, there may be more than one type of yarn within a knit layer (varying in materials, construction, and/or denier) or the yarns used may contain more than one type of fiber.

Preferably, the knit spacer fabric has a clo value measured by test ASTM F1868 of at least about 0.5 Clo (Rcf—fabric only) is a measure of insulative value of the fabric. In another embodiment, the knit spacer fabric has a clo value measured by test ASTM F1868 of at least about 0.3, more preferably at least about 0.7 (Rcf—fabric only). In another embodiment, the knit spacer fabric 10 has an air permeability of at least about 150 CFM, more preferably about 175 CFM, more preferably about 200 CFM, and more preferably about 225 CFM.

When the fabric 10 is made into an article of clothing (also referred to as a garment), in one embodiment the lower surface 10*b* would be facing away from the wearer and upper surface 10*a* would be facing towards the wearer. In another embodiment, the lower surface 10*b* would be facing the wearer and upper surface 10*a* would be facing away from the wearer. The knit spacer fabric 10 is a unitary material that is formed together in a knitting machine, the fabric layers 100, 200 are not formed as discrete knit layers and then joined together in a later operation. The fabric 10 may be made by any suitable knitting method, including both warp knitting and weft (or circular) knitting. The article of clothing may be any suitable article including but not limited to a shirt, jacket, pants, tights, leggings, hat, undergarments, and socks.

In another embodiment, a garment may use the fabric 10 in addition to other fabric. For example, a shirt might use the fabric 10 of the invention on the torso and another fabric in the sleeves. Additionally, the fabric of the invention could also be used as an insert.

In a preferred embodiment, the knit spacer fabric 10 is attached (by quilting, stitches, or the like) to at least one additional textile. This textile can be a woven or knit fabric and may form the outer portion of the garment or the inner portion of the garment. In another embodiment, the knit spacer fabric 10 is sandwich between two additional textiles. This allows the knit spacer fabric 10 to function as an insulation layer without fear of snagging, abrasion, or other wear because it is protected on both sides with other textiles (which can be woven or knit). The knit spacer fabric 10 can be laminated or bonded using an adhesive (or otherwise attached using stitches, grommets, or the like). The knit spacer fabric 10 may also be coated with any suitable material such as, but not limited to, a foamed latex, anti-static material, anti-fungal material, soil release chemistry, colorant, hydrophilic chemistry, or hydrophobic chemistry.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein. The term "about" is used in the application to designate an approximate number. Unless otherwise specified, the term "about" means within plus or minus 10% of that number. For example, if the number about 10 mm were given, this means 9-11 mm.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A knit spacer fabric having an upper surface and a lower surface and comprising:

an upper fabric layer comprising a plurality of upper yarns, wherein the upper fabric layer forms the upper surface of the knit spacer fabric;

a lower fabric layer comprising a plurality of lower yarns, wherein the lower fabric layer forms the lower surface of the knit spacer fabric;

a plurality of zipper connecting yarns; and, a plurality of linking connecting yarns;

wherein the upper fabric layer comprises a plurality of spaced apart parallel knitted upper columns, wherein each upper column is formed from at least two upper yarns knitted together, and wherein the upper yarns from one column are not knitted with the upper yarns of adjacent columns;

wherein the lower fabric layer comprises a plurality of spaced apart parallel knitted lower columns, wherein each lower column is formed from at least two lower yarns knitted together, and wherein the lower yarns from one column are not knitted with the lower yarns of adjacent columns, and wherein each lower column is unconnected to the adjacent lower column;

wherein at least a portion of the zipper connecting yarns comprise a repeating pattern of at least one stitch in one upper column and at least one stitch in an adjacent upper column;

wherein at least a portion of the linking connecting yarns comprise a repeating pattern of a plurality of stitches in a single lower column and at least one stitch in one upper column.

2. The knit spacer fabric of claim 1, wherein each upper column is formed from at least two upper yarns knitted together in a pillar stitch.

3. The knit spacer fabric of claim 1, wherein each lower column is formed from at least two upper yarns knitted together in a pillar stitch.

4. The knit spacer fabric of claim 1, wherein the knitted upper columns are parallel to the knitted lower columns.

5. The knit spacer fabric of claim 1, wherein the knitted lower columns are in registration with knitted upper columns.

6. The knit spacer fabric of claim 1, wherein each upper column is formed from at least two upper yarns and at least one zipper connecting yarn knitted together.

7. The knit spacer fabric of claim 1, wherein the first pattern section comprises a repeating pattern of one stitch in one upper column and one stitch in an adjacent upper column.

8. The knit spacer fabric of claim 1, wherein at least one of the zipper connecting yarns and the linking connecting yarns are elastic.

9. The knit spacer fabric of claim 1, wherein the knit spacer fabric is attached to an additional textile layer.

10. A garment comprising a knit spacer fabric having an upper surface and a lower surface, wherein the knit spacer fabric comprises:

an upper fabric layer comprising a plurality of upper yarns, wherein the upper fabric layer forms the upper surface of the knit spacer fabric;

a lower fabric layer comprising a plurality of lower yarns, wherein the lower fabric layer forms the lower surface of the knit spacer fabric;

a plurality of zipper connecting yarns; and, a plurality of linking connecting yarns;

wherein the upper fabric layer comprises a plurality of spaced apart parallel knitted upper columns, wherein each upper column is formed from at least two upper yarns knitted together, and wherein the upper yarns from one column are not knitted with the upper yarns of adjacent columns;

wherein the lower fabric layer comprises a plurality of spaced apart parallel knitted lower columns, wherein each lower column is formed from at least two lower yarns knitted together, and wherein the lower yarns from one column are not knitted with the lower yarns of adjacent columns, and wherein each lower column is unconnected to the adjacent lower column;

wherein at least a portion of the zipper connecting yarns comprise a repeating pattern of at least one stitch in one upper column and at least one stitch in an adjacent upper column;

wherein at least a portion of the linking connecting yarns comprise a repeating pattern of a plurality of stitches in a single lower column and at least one stitch in one upper column.

11. The garment of claim 10, wherein each upper column is formed from at least two upper yarns knitted together in a pillar stitch.

12. The garment of claim 10, wherein each lower column is formed from at least two upper yarns knitted together in a pillar stitch.

13. The garment of claim 10, wherein the knitted upper columns are parallel to the knitted lower columns.

14. The garment of claim 10, wherein the knitted lower columns are in registration with knitted upper columns.

15. The garment of claim 10, wherein each lower column is unconnected to the adjacent lower column.

16. The garment of claim 10, wherein the first pattern section comprises a repeating pattern of one stitch in one upper column and one stitch in an adjacent upper column.

17. The garment of claim 10, wherein the garment comprises an additional textile layer.

18. The garment of claim 17, wherein the knit spacer fabric is attached to the additional textile layer.

19. The garment of claim 10, wherein the garment comprises two additional textile layers and the knit spacer fabric is located between the additional textile layers.

* * * * *